US005131205A

United States Patent [19]

Hermann

[11] Patent Number: 5,131,205

[45] Date of Patent: Jul. 21, 1992

[54] SLEEVE FOR AIDING IN THE AFFIXATION OF BOARD ON A SURFACE

[76] Inventor: Eric F. Hermann, Mountain Rd., Irvington, N.Y. 10533

[21] Appl. No.: 764,960

[22] Filed: Sep. 24, 1991

Related U.S. Application Data

[63] Continuation of Ser. No. 566,162, Aug. 10, 1990, abandoned.

[51] Int. Cl.[5] ..... E04B 1/00

[52] U.S. Cl. ..... 52/741; 52/747; 52/127.2

[58] Field of Search ..... 52/127.1, 127.2, 241, 52/283, 712, 749, 747, 741, DIG. 1

[56] References Cited

U.S. PATENT DOCUMENTS

| | | | |
|---|---|---|---|
| 2,942,703 | 6/1960 | Nelsson | 52/578 X |
| 4,021,979 | 5/1977 | Rez | 52/127.1 |
| 4,570,403 | 2/1986 | Dannemiller | 51/712 X |
| 4,936,065 | 6/1990 | Hutchinson | 52/460 X |

FOREIGN PATENT DOCUMENTS

| | | | |
|---|---|---|---|
| 172198 | 7/1960 | Sweden | 52/127.2 |

*Primary Examiner*—David A. Scherbel
*Assistant Examiner*—Lan Mai
*Attorney, Agent, or Firm*—Cohen, Pontani, Lieberman & Pavane

[57] ABSTRACT

A sleeve article which is made out of a rigid and durable material, e.g., varied metals, high-grade polyvinyl chloride, wood, which has a first portion which is to be removably affixed, substantially flat against the wall or ceiling intended to be covered or formed by the sheetrock, etc. The sheetrock sleeve article of the invention is to, further, include a second portion which is preferably attached to one side of the first portion and is offset from the first portion by an angle of from greater than 0° to less than 90° relative to the surface to be covered by the sheetrock to be installed, i.e., the second portion is offset from the first portion by an angle of from greater than 90° to less than 180°. Preferably, the angle existing between the first portion and second portion of the inventive article, as defined in the previous paragraph, should be from greater than 0° to about 45°, with such angle most preferably being approximately 20°, i.e., about a 20°-bend between the first and second portions of the sheetrock sleeve.

6 Claims, 1 Drawing Sheet

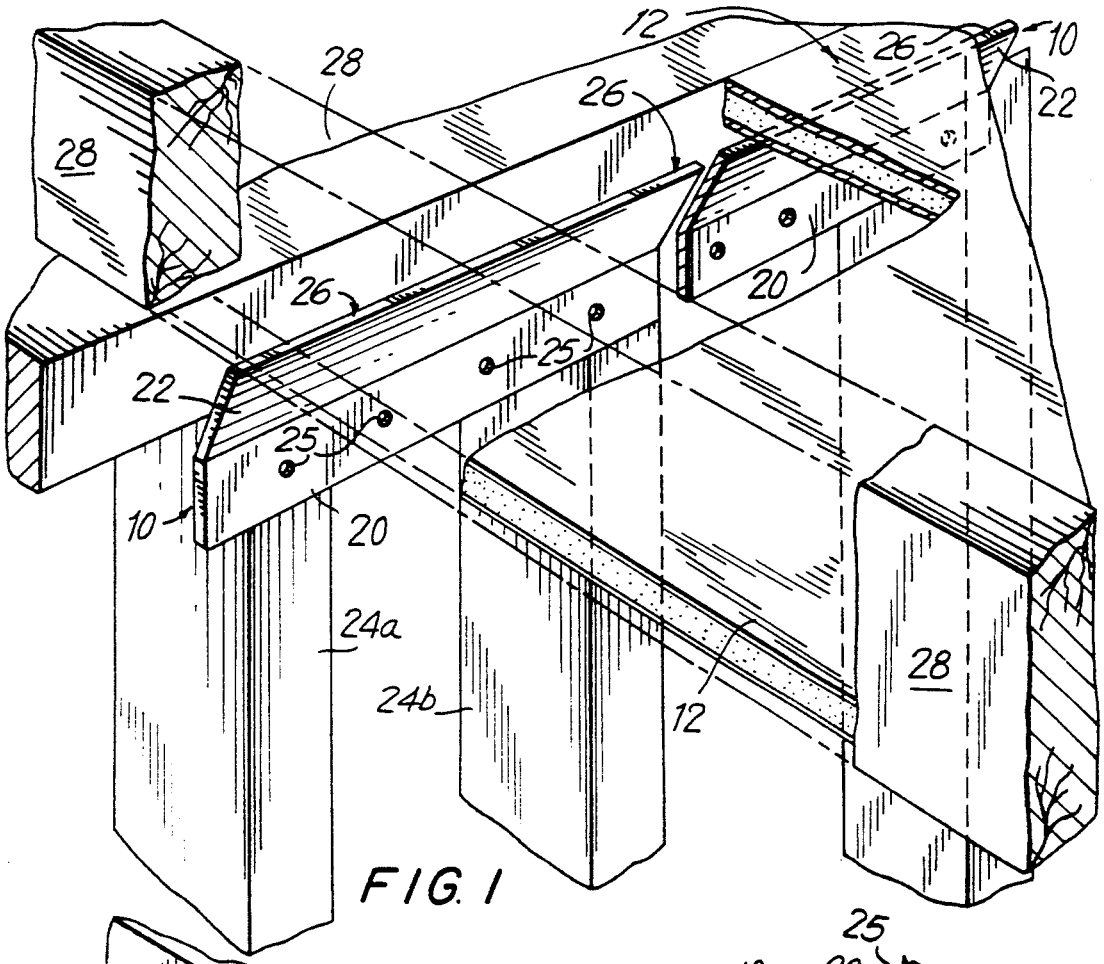
FIG. 1
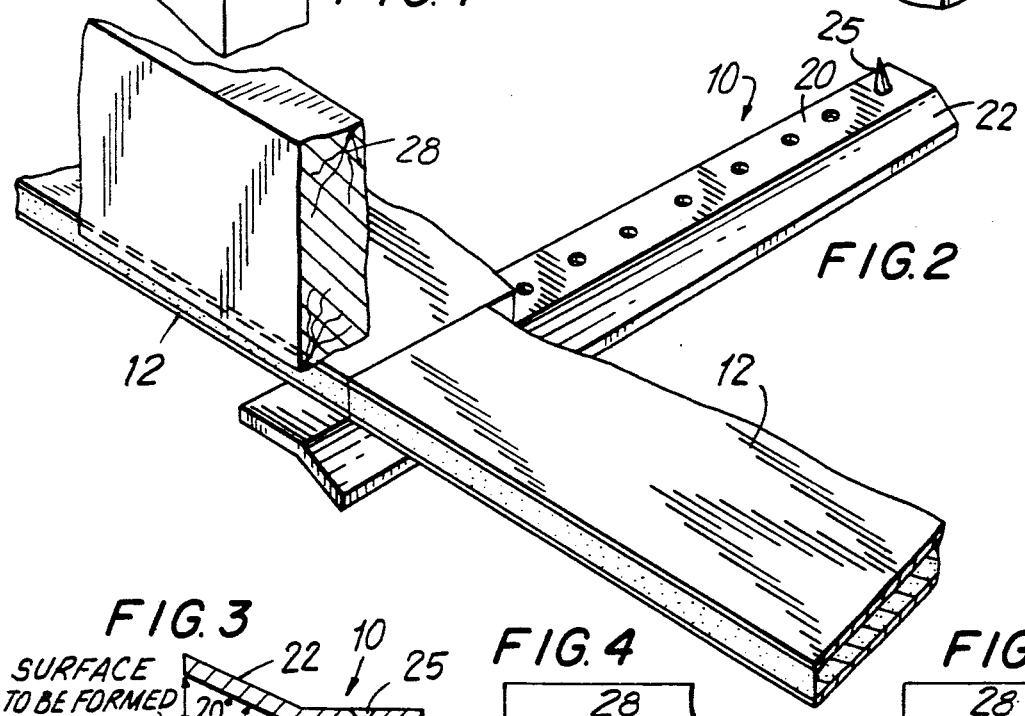
FIG. 2
FIG. 3
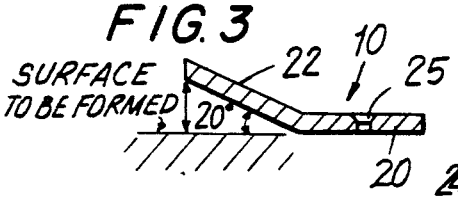
FIG. 4
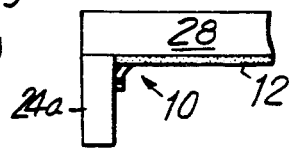
FIG. 5
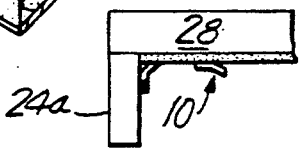

SLEEVE FOR AIDING IN THE AFFIXATION OF BOARD ON A SURFACE

This is a continuation of application Ser. No. 07/566,162 filed Aug. 10, 1990, now abandoned.

BACKGROUND OF THE INVENTION

1. Technical Field of the Invention

The present invention relates, generally, to a plaster wall/ceiling board sleeve. The plaster wall/ceiling board to be affixed to a surface by the sleeve of the present invention is well known by the trademark Sheetrock. It should be understood that similar boards commercially available under other trademarks can, of course, be readily affixed by way of the present invention. Reference throughout this Specification to Sheetrock shall therefore be understood as including all such equivalent materials.

More particularly, the present invention relates to a novel Sheetrock sleeve, which is both simplistic in its use and economical to manufacture and sell, which allows for the installation of, for example, gypsum wallboard. With the present invention, such wallboard, etc., may be installed by a single person, often in less time than current means, which generally require two or more persons and, thereby increase labor costs.

2. Description of the Prior Art

Heretofore, the installation of, for example, Sheetrock or wall board on a wall or ceiling of a room generally required two or more persons to retain, in proper alignment, the Sheetrock, etc., while a person, often a person other than one of the persons assisting in the alignment, applied the required securing means for permanent placement of the Sheetrock on wall or ceiling.

In such prior art means for installation, it was not uncommon for there to be a misalignment of Sheetrock, which often required the removal of the permanent securing means following installation. This process, like the initial installation, often required the participation of several persons.

The prior art fails to disclose or suggest means for the ready installation of Sheetrock, wall board, etc., which requires no more than the efforts of a single individual and still produces results equal to, if not in excess of, prior means known to the art.

The availability of means capable of utilization by only a single person will generally result in there being a reduction of labor costs over conventional means, thereby further increasing the efficiency of the claimed invention, described in detail hereinafter.

SUMMARY OF THE INVENTION

It is, therefore, an object of the present invention to provide a Sheetrock sleeve which enables a single individual to install Sheetrock, wall board, etc., on a wall or ceiling in proper alignment.

It is a further object of the present invention to provide a Sheetrock sleeve which is likely to reduce the amount of labor costs generally incurred in the conventional installation of Sheetrock on a wall or ceiling. It is, still, a further object of the present invention to provide a Sheetrock sleeve which is economical to produce and offer for sale.

It is, yet, a further object of the present invention to provide a Sheetrock sleeve for the installation of sheetrock, wallboard, etc., on a ceiling or wall which overcomes the disadvantages inherent in conventionally knows means.

The foregoing and related objects are achieved by the claimed sleeve article which is made out of a rigid and durable material, e.g., varied metals, high-grade polyvinyl chloride, wood, which has a first portion which is to be removably affixed, substantially flat against the wall or ceiling intended to be covered or formed by the Sheetrock, etc. The Sheetrock sleeve article of the invention is to, further, include a second portion which is preferably attached to one side of the first portion and is offset from the first portion by an angle of from greater than 0° to less than 90° relative to the surface to be covered by the Sheetrock to be installed, i.e., the second portion is offset from the first portion by an angle of from greater than 90° to less than 180°.

Preferably, the angle existing between the first portion and second portion of the inventive article, as defined in the previous paragraph, should be from greater than 0° to about 45°, with such angle most preferably being approximately 20°, i.e., about a 20°-bend between the first and second portions of the sheetrock sleeve article of the invention.

The means for removably securing the first portion of the article to the surface to be covered is a series of screws, preferably dry wall screws, which would be capable of insertion through a series of holes, preferably countersunk screw holes, provided in said first portion.

Both the first and second portions of the present invention are, preferably, rectangular in shape whereby the length of each is preferably one foot to 12 feet, while the width is preferably two inches to 10 inches. It should be understood that the foregoing are to be considered as being the preferred dimensions for constructing the present invention. The invention can be readily produced and utilized with first and second portions which do not fall within the foregoing ranges of lengths and widths.

The preferred dimension for said first and second portions is to produce each to have a length of three feet and a width of four inches.

The preferred thickness of each portion of the invention is preferably one inch or less, with the preferred dimension being 0.25 inches. The thickness can, of course, be greater than one inch, but it is generally believed that such additional thickness is unnecessary for carrying out the objects of the present invention.

Utilization of the Sheetrock sleeve article is carried out by removably affixing the first portion of the inventive sleeve to either wall studs or ceiling joists, as appropriate. Thereafter, the wall board, for example, is slide between the second portion of the sleeve article and the surface to be covered or formed. The wall board or Sheetrock is then permanently affixed to the wall studs or ceiling hoists by conventional means. Following such permanent affixation of the wall board or Sheetrock, the first portion of the invention is then removed from the wall studs or ceiling joists. This procedure is repeated for successive sheets of wall board, etc., as further shown and described.

Other objects and features of the present invention will become apparent when such is considered in connection with the accompanying drawing figures. It should, however, be noted that the accompanying drawing figures illustrate but a single preferred embodiment of the present invention and are not intended as a definition of the limits and scope of the present invention.

BRIEF DESCRIPTION OF THE DRAWING FIGURES

In the drawing, wherein similar reference numerals denote similar features throughout the several views:

FIG. 1 is a perspective view illustrating use of the Sheetrock sleeve of the present invention for the installation of a first Sheetrock sheet along a ceiling;

FIG. 2 is a further perspective view illustrating the use of the Sheetrock sleeve of the present invention for the installation additional Sheetrock sheets along a ceiling following installation of the initial sheet, as shown in FIG. 1;

FIG. 3 is a side view of the Sheetrock sleeve of the present invention relative to a flat surface;

FIG. 4 is a side view of the Sheetrock sleeve of the present invention showing the relationship between a wall stud, the article of the invention and a first sheet of Sheetrock to be secured to a ceiling; and, FIG. 5 is a further side view of the Sheetrock sleeve of the present invention showing the use of the same for securing a second sheet of Sheetrock to a ceiling joist.

DETAILED DESCRIPTION OF THE DRAWING FIGURES

Turning now, in detail, to an analysis of the accompanying drawing figures, FIG. 1 is a perspective view illustrating use of the Sheetrock sleeve 10 of the present invention for the installation of a first sheetrock sheet 12, shown partially broken away, for the purpose of forming a ceiling.

In FIG. 1, sleeve 10 is shown as being comprised of two portions 20 and 22, respectively, which are preferably rectangular. First portion 20 is provided with means 25 for the removable affixation of the same to either wall studs or ceiling joists. Such removable affixation means are preferably a series of drywall screws 25; the first portion 20 preferably being provided with a series of corresponding countersunk screw holes for said screws 25.

Sleeve 10 further includes a second portion 22 which is preferably attached to one edge of first portion 20 and is offset from first portion 20 by an angle of from greater than 0° to less than 90°, and preferably less than 45°, relative to the plane of the surface to be covered or formed. Most preferably, such angle is approximately 20°.

It is generally contemplated that first portion 20 and second portion 22 will be integrally constructed, however, such need not be the case. An integral construction is preferred. Sleeve 10 is preferably made of various metals or a high-grade polyvinyl chloride composition, though the use of other materials is possible.

Again considering FIG. 1, sleeve 10 is shown as being removably affixed to at least two wall studs, 24*a*, 24*b*, by a series of screws 25. Once so secured, board 12, which is partially shown in phantom, is able to be insertd between the horizontal, lengthwise edge of second portion 22, said edge being designated by reference numeral 26, and ceiling joist 28, partially shown in phantom.

Placement of board 12 in the manner described in the previous paragraph allows sleeve 10 (more particularly, second portion 22) to sufficiently retain one side of board 12 in place while a person permanently affixes board 12 to a series of ceiling joists 28. Such permanent affixation of board 12 is by conventional means. Once board 12 is permanently affixed, sleeve 10, i.e., first portion 20, is removed from wall studs 24*a*, 24*b*. Placement of a second, adjoining board may then take place.

FIG. 2 is a further prospective view illustrating the use of the sheetrock sleeve 10 of the present invention for the installation of additional sheetrock sheets, or boards 12, for forming a ceiling following installation of the initial sheet 12, as shown in FIG. 1.

For attachment of a second board 12, by means of the sleeve 10 of the present invention, first portion 20 is removably affixed by screws 25 to ceiling joist 28 (one ceiling joist partially shown in FIG. 2) Once so attached, a second board 12 is able to be slid, or wedged, between second portion 22 and the series of ceiling joists to which said board 12 is to be permanently affixed. Board 12 is able to sufficiently retained between second portion 22 and the series of ceiling joists by virtue of the acute angle provided between said first portion 20 and said second portion 22, said angle being defined relative to the surface of the sheetrock, i.e., the surface to be formed, as best shown in FIG. 3.

When wedged in the manner as described in the previous paragraph, board 12 is able to be readily secured in a permanent fashion by a single individual. Following such permanent securement, which is carried out in a conventional fashion, first portion 20 is remoed and additional adjoining boards may be secured by a similar procedure.

FIG. 3 is a side view of the sheetrock sleeve of the present invention relative to a flat surface, or surface to be formed. This figure, as referred to above, illustrates the preferred angle between first portion 20 and second portion 22, as well as how such angel is defined in the instant disclosure. It is noted that such angle is defined relative to the plane of the surface to be formed via use of sleeve 10. Sleeve 10 may be made to have other angles, either larger smaller, than that shown in FIG. 3, which represents a perferred embodiment.

FIG. 4 is a side view of the sheetrock sleeve 10 of the present invention showing the relationship between a wall stud 24*a*, the sleeve 10 of the invention and a first sheet 12 of sheetrock to be secured to a ceiling (additional ceiling joist shown by reference numeral 28.)

As described in greater detail, relative to FIg. 1, sleeve 10 is removably affixed to wall stud 24*a* by first portion 10. Board 12 is then able to be slid between ceiling joist 28 and edge 26 of second portion 22 until one edge of board 12 is adjacent to the wall stud. Board 12 is then able to be permanently secured to ceiling joists 28, in a conventional manner. Sleeve 10 can then be removed in the manner described above.

FIG.5 is a further side view of the sheetrock sleeve 10 of the present invention showing the use of the same for securing a second sheet 12 of sheetrock to a ceiling joist. This view illustrates the attachment procedure previously described relative to FIG. 2. Again, first portion 20 is removably secured to ceiling joist 28. A second board 12 is then wedged between the ceiling joists, for the surface to be formed, and second portion 22 of sleeve 10. Board 12 may then be permanently secured to ceiling joists 28, in a conventional manner, and sleeve 10 may then be removed. The procedure of FIG. 5 is then repeated for successively adjoining boards 12.

It will be apparent to those of ordinary skill in the art that numerous modifications may be made to the present invention. The materials of which the present invention is made may be readily varied, as well as the particular dimensions of the first and second portions of the present invention.

While only several embodiments of the present invention have been shown and described, it will be obvious to those of ordinary skill in the art that many modifications may be made to the present invention without departing from the spirit and scope thereof.

What is claimed is:

1. A method for installing sheets of constuction material to a plurality of construction support devices whereby an individual can install said sheets of construction material single-handedly and achieve proper alignment, comprising the steps of:

providing a sleeve article having a first portion and a second portion, said first portion having an angular orientation with respect to said second portion, and wherein said first portion is to be removably affixed to said plurality of construction support devices;

removably affixing said first portion of said sleeve article to at least one construction support device;

guiding one end of said sheet of construction material until said one end of said sheet of construction material is securely seated between said second portion and said at least one construction support device;

permanently affixing the other end of said sheet of construction material to a construction support device; and removing said sleeve article from said at least one construction support device.

2. A method according to claim 1, wherein said plurality of construction support devices comprise a plurality of wall studs and first and second ceiling joists, said wall studs having upper ends for supporting a first ceiling joist, said first ceiling joist supporting a second ceiling joist perpendicular to said first ceiling joist, and wherein said second portion of said sleeve article has a lengthwise edge; and wherein said step of removably affixing said first portion of said sleeve article to a construction support device comprises removably affixing said first portion of said sleeve article to at least one wall stud near the upper end therof with said second portion of said sleeve article positioned to form a gap between said lengthwise edge of said second portion and said second ceiling joist;

wherein said step of guiding said sheet of construction material comprises guiding one end of said sheet of construction material until said one end therof is securely seated between said lengthwise edge of said second portion and said second ceiling joist;

wherein said pemanently affixing step comprises permanently affixing the other end of said sheet of construction material to said second ceiling joist; and wherein said removing step comprises removing said first portion of said sleeve article from said at least one wall stud.

3. The method of claim 2, further comprising the step of permanently affixing said one end of said sheet of construction material to a construction support device.

4. A method according to claim 2, wherein at least some of said plurality of construction support devices comprise a plurality of ceiling joisea dna at least one installed sheet of ceiling construction material; and wherein said step of removably affixing said first portion of said sleeve article to at least one construction support deice comprises removably affixing said first portion to a permanently installed ceiling sheet of construction material with said first portion positioned at one end of said permanently installed sheet of construction material and with said second portion extending beyond said one end of said permanently installed sheet of construction material and angled downward therefrom;

wherein said guiding step comprises guiding another sheet of construction material until an end of said another sheet of construction material abuts the end of said permanently installed sheet of construction material;

wherein said permanent affixing step comprises permanently affixing the other end of said another sheet of construction material to a ceiling joist; and wherein said removing step comprises removing said first portion from said permanently installed sheet of construction material.

5. The method of claim 3, further comprising the step of permanently affixing said one end of said another sheet of construction material to a construction support device.

6. The method of claim 1, further comprising the step of permanently affixing said one end of said sheet of construction material to a construction support device.

* * * * *

UNITED STATES PATENT AND TRADEMARK OFFICE
CERTIFICATE OF CORRECTION

PATENT NO. : 5,131,205

DATED : July 21, 1992

INVENTOR(S) : Eric F. Hermann

It is certified that error appears in the above-identified patent and that said Letters Patent is hereby corrected as shown below:

On the Title page, item [21] Appl. No.: should be corrected to read as --764,950--.

Signed and Sealed this

Second Day of April, 1996

*Attest:*

*Attesting Officer*

BRUCE LEHMAN

*Commissioner of Patents and Trademarks*